United States Patent [19]
Norton
[11] 4,203,728
[45] May 20, 1980

[54] FUEL COMPOSITION COMPRISING A COAL-OIL SLURRY

[75] Inventor: Richard V. Norton, Wilmington, Pa.
[73] Assignee: Suntech, Inc., Wayne, Pa.

[21] Appl. No.: 772,416
[22] Filed: Feb. 28, 1977
[51] Int. Cl.² ..... C10L 1/32
[52] U.S. Cl. ..... 44/51
[58] Field of Search ..... 44/51, 1 R; 252/309

[56] References Cited

U.S. PATENT DOCUMENTS 1,390,230 9/1921 Bates ..... 44/51
2,242,822 5/1941 Fuchs ..... 44/51
2,338,634 1/1944 Fuchs ..... 44/1 R
3,022,251 2/1962 Thiegs ..... 252/307

*Primary Examiner*—Winston A. Douglas
*Assistant Examiner*—Y. Harris-Smith
*Attorney, Agent, or Firm*—J. Edward Hess; Donald R. Johnson; Paul Lipsitz

[57] ABSTRACT

In the process of preparing a slurry comprising oil and comminuted coal for transport through pipelines and use as fuel, the improvement of increasing the suspension stability of the coal particles in the oil by oxidizing the surface of the coal particles prior to preparation of the slurry.

4 Claims, No Drawings

FUEL COMPOSITION COMPRISING A COAL-OIL SLURRY

The transport of coal as a slurry in a pipeline to point of use as fuel is known in the art and is described, for example, in U.S. Pat. No. 3,907,134. As pointed out in that patent several difficulties arise with such slurries, one of which is the settling of the coal particle. Various agents have been used to mitigate the problem, but, to date, the stability of the coal suspension in the oil still hinders the development of this means of coal transport.

It has now been found that the suspension stability of an oil-coal slurry is improved if the coal particles are subjected to a surface oxidation before preparing the slurry. The surface oxidation of the coal is carried out in accord with known techniques, such as those disclosed in the Supplementary Volume of the text "Chemistry of Coal Utilization" edited by H. H. Lowry, John Wiley & Sons, New York, 1963 (see particularly pages 272 et seq.), which text is hereby incorporated by reference. Thus, surface oxidation of the coal may be achieved by passing air over the coal particles for a brief time, or by spraying with aqueous solutions of alkaline permanganate, hydrogen peroxide, ozone solutions, and the like. When such aqueous solutions are used, any excess liquid is allowed to drain off before making the slurry. It will be understood, however, that a very convenient technique for the oxidation is simply to oxidize the coal with air (preferably hot air at from about 120° to 350° C., preferably 200° to 280° C.) while the coal is conveyed by a moving metal screen to the point of making the coal-oil slurry. Also, it will be understood that after the oxidation step, the coal may be further comminuted. As is well known, coal composition and moisture content varies with source and for this reason the determination of the extent of oxidation must be done on an empirical basis by removing samples and correlating with standards. The degree to which the coal surface becomes acidic is a measure of oxidation and is proportional to increased slurry stability.

Such surface oxidation is believed to form various humic acids and probably some benzenoid acids as well as phenolic type acids on the coal surface. Also the oxidation state of ionic impurities on the coal surface is increased. The partially oxidized coal may be characterized by the presence on its surface of phenolic acids in an amount of from about 20 to about 200 meg. of $H^+$/100 g. and of carboxylic acids in an amount of from about 1.3 to about 4 meg. of $H^+$/100 g. As will be observed, most of the acidity is phenolic acidity as the carboxylic acidity is comparatively low. From a technical standpoint it seems unlikely that such oxidation resulting in increased acidity would contribute to oil-coal suspension stability, nevertheless the mildly oxidized coal does show a greater stability as an oil slurry.

In preparing the coal-oil slurry other ingredients may, of course, be included for various specific purposes. Thus, slurry stabilizing agents may be added to augment the oxidation effects and viscosity reducing agents may be added, if desired. These agents are often amine derivatives and thus basic in nature and will react with the acid sites on the coal to form stabilizing agents in situ (e.g. quaternary ammonium salts).

In order to further illustrate the invention the following examples are given:

EXAMPLE 1

The chemical change effected by surface oxidation of coal is illustrated by this example. Potentiometric titration of a water slurry of oxidized and unoxidized dry 60–80 mesh Wyodak coal indicates a significant increase in phenolic content for the oxidized coal as shown by the following table:

| | Acidity-Meg. $H^+$ per 100g Coal | |
|---|---|---|
| | Aromatic Acids pH 6.5–7.5 | Phenolic Acids pH 8–9 |
| Unoxidized Coal | 1.14 | 0.0 |
| Oxidized Coal | 1.38 | 29.2 |

EXAMPLE 2

Two coal-oil suspensions containing 35% by weight of Wyodak coal 100 gm coal of (100–200 mesh) in No. 2 heating oil were prepared. The coal used in one suspension had been oxidized by blowing with air at 200° F. for 3 minutes. Each suspension was tested for settling characteristics by centrifuging the suspensions and observing the amounts of settling in each case. The following table indicates the data obtained:

| SUSPENSION SETTLING TEST | | |
|---|---|---|
| | Oxidized Coal | Unoxidized Coal |
| Full centrifuge speed (3 minutes) | complete settling | complete settling |
| Full speed (1 minute) | only a small amount of coal settling | very noticeable (about 50%) settling has occurred. |
| Half speed (1 minute) | no visible settling | about 10% settled |

The above data clearly demonstrates that there is a unique property of the oxidized coal which enhances suspension stability.

The invention claimed is:

1. A process for preparing a slurry comprising oil and comminuted coal for transport through pipelines and use as fuel wherein the suspension stability of said coal particles in the oil is increased which comprises oxidizing the surface of said coal particles and then slurrying said coal in said oil.

2. A process for preparing a slurry comprising oil and comminuted coal for transport through pipelines and use as fuel wherein the suspension stability of said coal particles in the oil is increased, which comprises oxidizing the surface of said coal particles prior to preparation of said slurry, said coal oxidation being carried out to increase the acidity on the surface of said coal, the level of phenolic acids being from about 20 to about 200 milli-equivalents of hydrogen ion per 100 g. of coal and the level of carboxylic acids being from about 1.3 to about 4 milli-equivalents of hydrogen ion per 100 g. of coal and then slurrying said coal in said oil.

3. The process of claim 2 where the coal is Wyodak coal.

4. A slurry of oil and comminuted coal which has improved suspension stability for transport of said slurry by pipeline which comprises oil and comminuted coal which comminuted coal has been partially oxidized by blowing with air at a temperature of from about 120° to about 350° C. so as to increase the surface acidity of said coal.

* * * * *